United States Patent [19]

Kawabata et al.

[11] Patent Number: 4,459,034

[45] Date of Patent: Jul. 10, 1984

[54] TIME DISPLAY APPARATUS

[75] Inventors: Keiji Kawabata, Kawanishi; Yoshio Nakao, Ikeda, both of Japan

[73] Assignee: Mitsubishi Denki Kabushiki Kaisha, Japan

[21] Appl. No.: 446,511

[22] Filed: Dec. 3, 1982

[30] Foreign Application Priority Data

Dec. 24, 1981 [JP] Japan ..... 56-212008

[51] Int. Cl.[3] ..... G04B 19/00; G04B 19/30; G04B 19/06

[52] U.S. Cl. ..... 368/240; 368/82

[58] Field of Search ..... 368/82, 83, 84, 239, 368/240, 241, 242

[56] References Cited

U.S. PATENT DOCUMENTS

| | | | |
|---|---|---|---|
| 3,823,549 | 7/1974 | Feldman | 368/82 |
| 3,839,857 | 10/1974 | Berets et al. | 368/240 X |
| 3,844,105 | 10/1974 | Kashio | 368/82 |
| 3,908,355 | 9/1975 | Wiesner | 368/240 X |
| 3,919,835 | 11/1975 | Kashio | 368/240 X |
| 4,149,368 | 4/1979 | Nakamura et al. | 368/240 |
| 4,198,810 | 4/1980 | Fahrenschon | 368/240 X |
| 4,209,974 | 7/1980 | Noble | 368/240 X |

*Primary Examiner*—J. V. Truhe
*Assistant Examiner*—Terry Flower
*Attorney, Agent, or Firm*—Leydig, Voit, Osann, Mayer and Holt, Ltd.

[57] ABSTRACT

A time display apparatus for producing an analog-type display using liquid crystal display elements, electrochomic display elements, or the like is described. The display of this apparatus is divided into two parts: a main display portion for indicating the hour and for indicating the number of minutes past the hour in units of 2.5 minutes, and an auxiliary display portion for indicating the number of minutes in units of 1 minute. The main display portion requires 48 display elements, and the auxiliary display portion requires 4 elements, compared to 120 elements required in conventional time displays. Through this reduction in the number of elements, a small-sized, low-priced display apparatus can be achieved.

8 Claims, 12 Drawing Figures

TIME DISPLAY APPARATUS

BACKGROUND OF THE INVENTION

This invention relates to a time display apparatus for indicating the time of day in hours and minutes using liquid crystal display elements, electrochromic display elements, or the like.

Hitherto existing time display devices of this kind for displaying time in an analog manner have used a display device like that shown in FIG. 1. In this figure, sixty long, rectangular display elements A1–A60 are substantially equally spaced about a ring so as to form a first display group. About the outer circumference of this first display group A1–A60 are arranged sixty more display elements B1–B60 to form a second display group, each element of this second display element group aligned so as to point in the same radial direction as the corresponding element of the first display element group. With 60 elements in each group, display elements A1–A60 and B1–B60 of the first and second display element groups are provided on time display board 50 in locations corresponding to 1 to 60 minutes of the hour.

The display of time using this time display board 50 is carried out by the selective driving of the first and second display element groups, A1–A60 and B1–B60, with the first display element group producing a display equivalent to that produced by the hour hand of a conventional watch, and a combination of display elements of the first and second groups producing a display equivalent to that produced by the minute hand of a conventional watch.

Such a display is shown in FIG. 1, in which element A46 is driven together with the combination of elements A2 and B2 to represent, respectively, an hour hand and a minute hand and display the time 9:01.

However, in this time display board 50, a total of 120 display elements are necessary for the first and second display element groups, A1–A60 and B1–B60, and a correspondingly large number of driving circuits is necessary to drive the drive display board 50. Such a display board thus has the drawback that a small-sized, low-priced display cannot be produced.

SUMMARY OF THE INVENTION

It is the object of the present invention to provide a time display apparatus for which decreases in size and cost can be achieved, thereby overcoming the above-described drawbacks of displays of the prior art. This is achieved by dividing the time display of the present invention into a main display portion, consisting of first and second display element groups, and an auxiliary display portion. The first and second display element groups are both composed of 24 display elements, and the auxiliary display portion consists of but 4 display elements. Thus the total number of display elements is reduced by more than one half from the 120 of the prior art to 52 elements.

The main display portion is used to indicate the approximate time in units of 2.5 minutes, and the auxiliary display portion is used to indicate the precise number of minutes after the hour in units of one minute. Thus, the time display apparatus of the present invention, although using a greatly reduced number of display elements, possesses the same ability as conventional time displays of allowing the time to be read in units of one minute.

The various features of the present invention will become clear upon reading the following description and upon studying the accompanying drawings.

DESCRIPTION OF THE PREFERRED EMBODIMENTS

Figure 1:
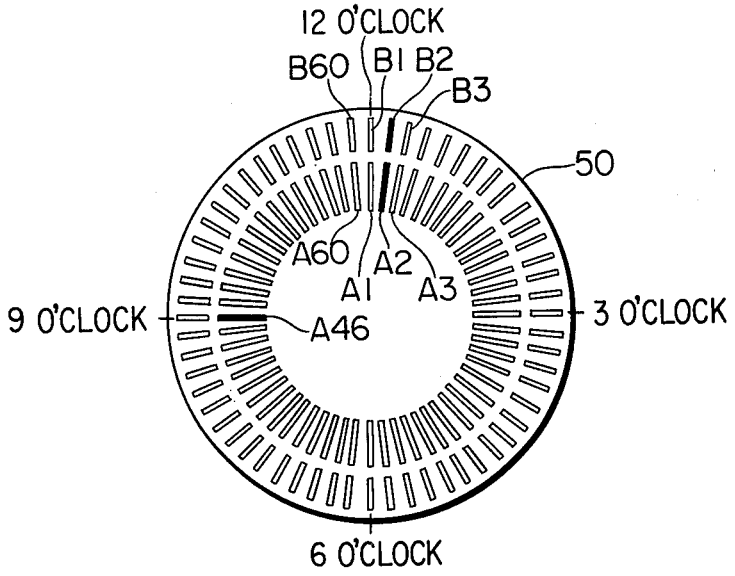
FIG. 1 PRIOR ART
FIG. 1 is a plan view of a time display device of the prior art.
Figure 2:
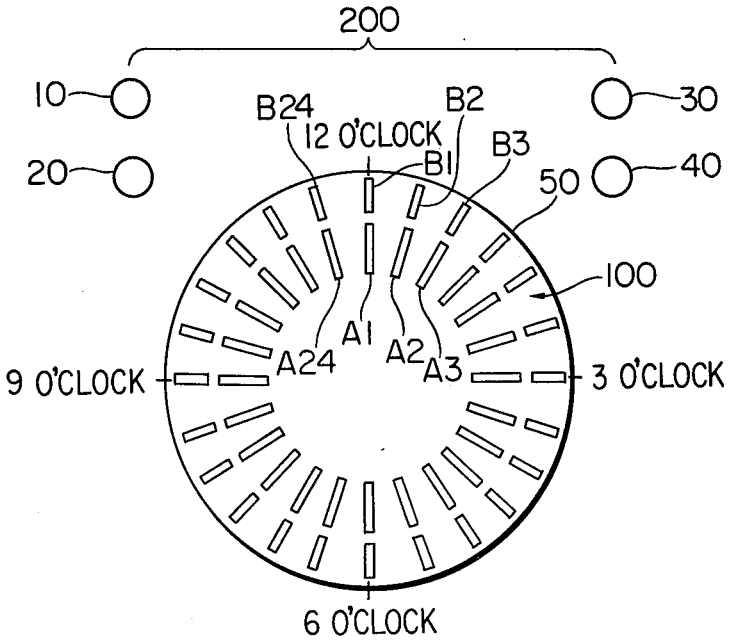
FIG. 2 is a plan view of one embodiment of the present invention.

One embodiment of the present invention, illustrated in FIG. 2, will now be explained. First, long, rectangular display elements A1–A24 are disposed with substantially equal spacing about a ring to form a first display element group.

Around the outer circumference of this first display element group A1–A24 is arranged a second display element group consisting of display elements B1–B24. Each of display elements B1–B24 is arranged so as to be aligned in the radial direction with a corresponding element of the first display element group A1–A24. Outside of the second display element group A1–B24 are arranged third, fourth, fifth, and sixth display elements, indicated by reference numerals 10, 20, 30, and 40, respectively. The elements of the first and second display element groups A1–A24 and B1–B24 are arranged around time display board 50 at roughly 2.5 minute intervals. The indication of time on the time display board 50 is carried out by selectively driving first and second display element groups A1–A24 and B1–B24. The first display element group A1–A24 produces a display corresponding to that produced by the hour hand of a conventional watch, and by driving an element of the first display element group together with the corresponding element of the second display element group, a display is produced corresponding to that produced by the minute hand of a conventional watch.

The first and second display element groups in this way constitute a main display portion 100 for displaying hours and minutes.

In the first display element group, since there are only 24 display elements for indicating the hour, this display advances every 30 minutes.

The second display element group also has only 24 elements, so it is only possible to display the number of minutes past the hour in units of 2.5 minutes (60 minutes/24=2.5 minutes). For the purpose of displaying the number of minutes in units of one minute, an auxiliary display portion 200 is provided, consisting of third through sixth display elements, 10, 20, 30, and 40, respectively. Three different modes of indicating the time using main display portion 100 and auxiliary display portion 200 will be described below.

Mode 1: The third display element 10 is driven when the number of minutes past the hour is a number ending in 1 or 6(1, 6, 11, 16, 21, etc.). When the number of minutes past the hour is a number ending in 2 or 7 (2, 7, 12, 17, 22, etc.), the fourth display element 20 is driven. In a similar manner, the fifth display element 30 is driven when the number of minutes past the hour is a number ending in 3 or 8 (3, 8, 13, 18, 23, etc.), and the sixth display element 40 is driven when the number of minutes is a number ending in 4 or 9 (4, 9, 14, 19, 24, etc.).

To make this more clear, FIGS. 3 through 6 illustrate one example of time display using the above-described display mode, showing the relationship between the main display portion 100 consisting of first and second display element groups, and auxiliary display portion 200 consisting of third, fourth, fifth, and sixth display elements. FIGS. 3–6 show displays of 9:00, 9:01, 9:05 and 9:08, respectively.

There are of course times when it is not necessary to know the exact time, when a rough approximation of the time is all that is required. In these cases, it is not necessary to drive the auxiliary display portion 200, and the display of time in units of 2.5 minutes produced by driving only the main display portion 100 is sufficient, and when it is necessary to know the time in units of one minute, such as when adjusting the display, the auxiliary display portion 200 may then be driven together with the main display portion 100.

Mode 2: This second mode of display differs from the first in the operation of the auxiliary display portion 200. When the number of minutes past the hour is a number ending in 1, 2, 3, 4, 6, 7, 8, or 9, the third display element 10 is driven. The fourth display element 20 is driven when the number of minutes past the hour is a number ending in 2, 3, 4, 7, 8, or 9. Similarly, the fifth display element 30 is driven when the number of minutes ends in 3, 4, 8, or 9, and the sixth display element is driven only when the number of minutes past the hour ends in 4 or 9.

Thus, in this mode of display, when only one display element is driven (element 10), the number of minutes past the hour is a number ending in 1 or 6. When two display elements are driven simultaneously (elements 10 and 20), the number of minutes ends in 2 or 7. When three display elements are driven at the same time (elements 10, 20, and 30), the number of minutes ends in 3 or 8. Finally, when all four display elements are driven, the number of minutes ends in 4 or 9. When the number of minutes past the hour is a number ending in 0 or 5, none of the four display elements of the auxiliary display portion 200 are driven, and the time is read from the main display portion 100 alone.

Figure 3:
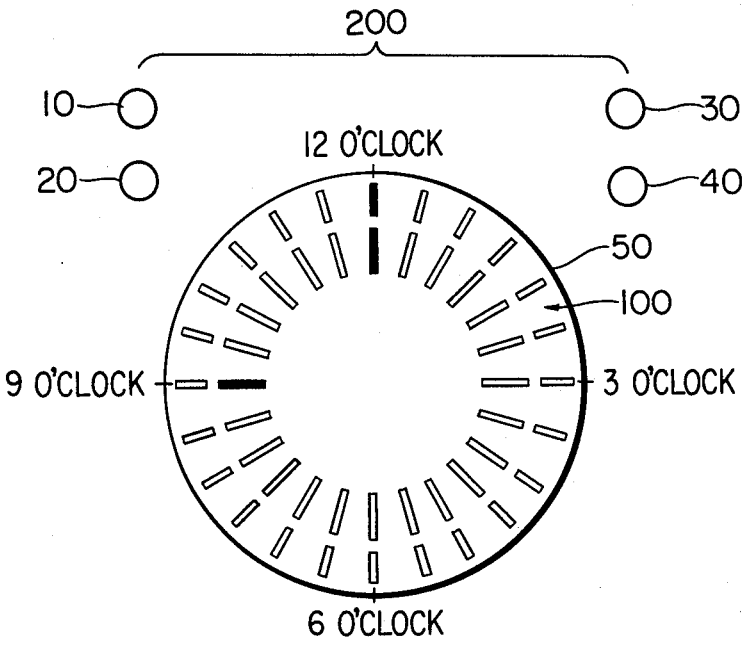
FIGS. 3–10 and 12 demonstrate the display produced at various times by the embodiment shown in FIG. 2.
Figure 4:
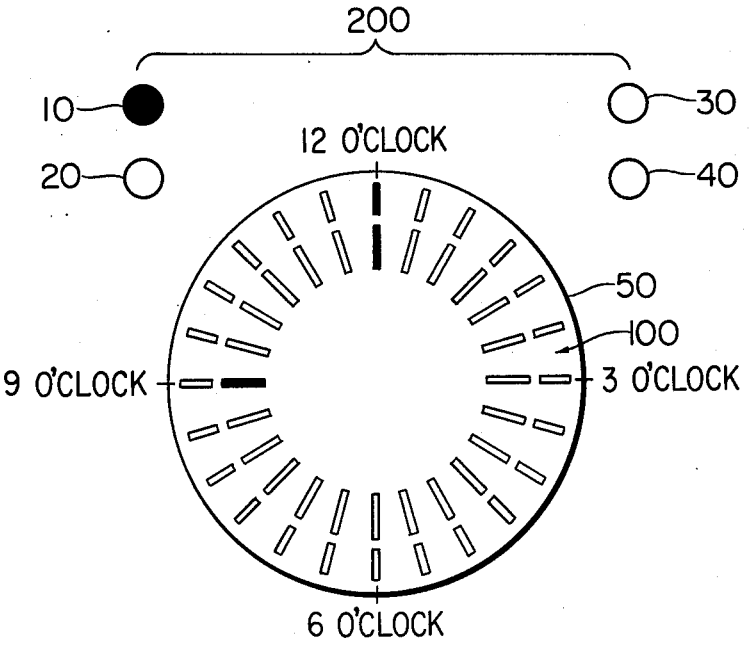
Figure 5:
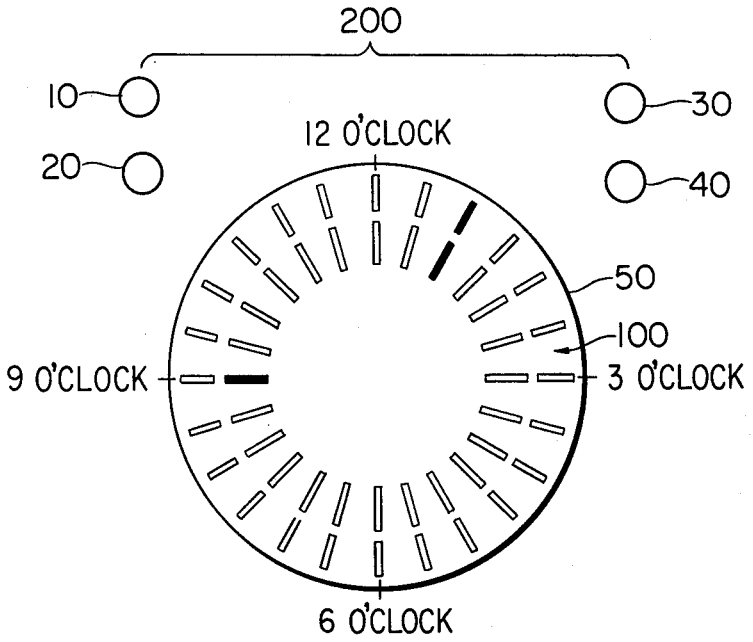
Figure 6:
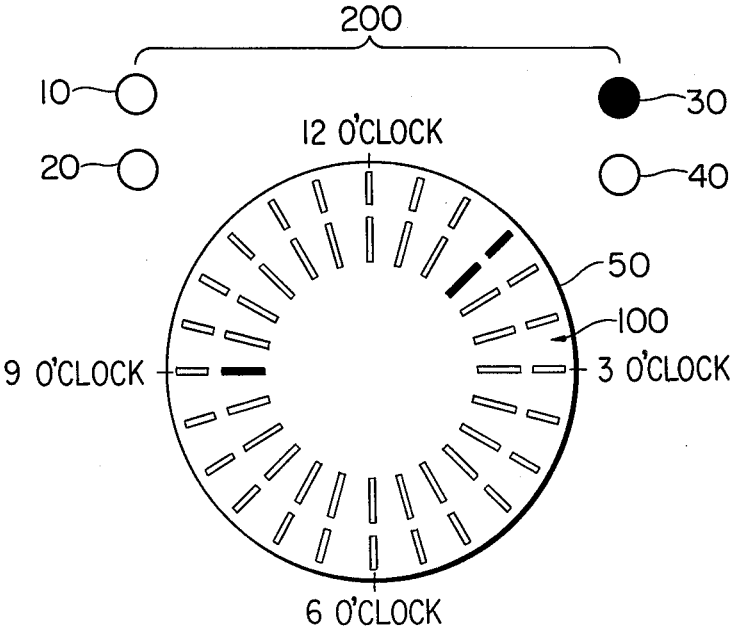
Figure 7:
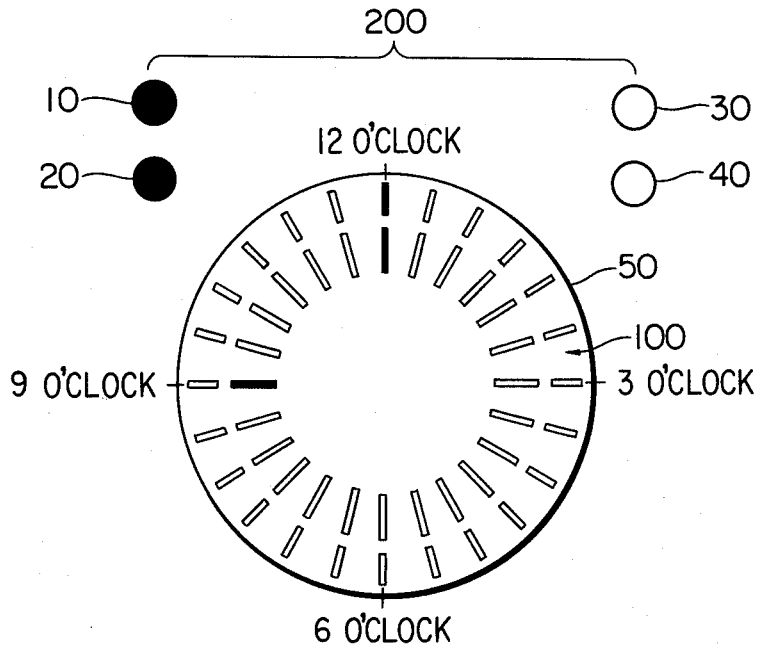
Figure 8:
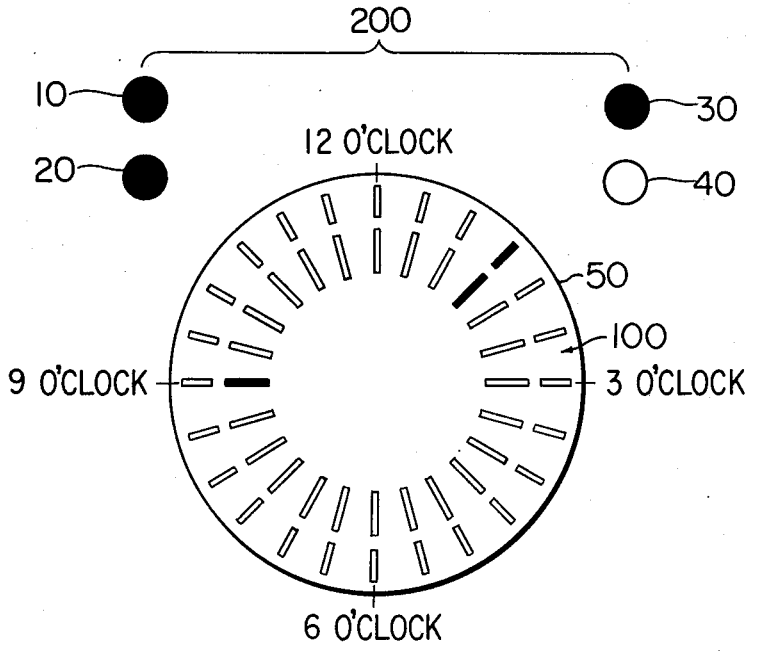

Concrete examples of this mode of display can be seen by referring to the figures. Displays of 9:00, 9:01, and 9:05 are shown in FIGS. 3, 4, and 5, respectively, while displays of 9:02 and 9:08 are shown in FIGS. 7 and 8, respectively.

With this display mode as well, it is possible, if one so wishes, to use only the main display portion 100 during the normal display of time in units of 2.5 minutes, and to use the auxiliary display portion 200 together with the main display portion 100 only when it is desired to know the time in units of one minute, as when adjusting the display.

Mode 3: In this mode, normal display is performed only by the main display portion 100 in units of 2.5 minutes, and the auxiliary display portion 200 is driven only when one wishes to know the time in units of 1 minute, such as when adjusting the display.

The auxiliary display 200, when driven, produces the same sort of display as in Mode 1. Namely, the third display element 10 is driven when the number of minutes after the hour is a number ending in 1 or 6, the fourth display element 20 is driven when the number of minutes ends in 2 or 7, the fifth display element 30 is driven when the number of minutes ends in 3 or 8, and the sixth display element 40 is driven when the number of minutes ends in 4 or 9.

What is different about this mode of display is that when the main display portion 100 is driven simultaneously with the auxiliary display portion 200, the former displays time in units of 5 minutes instead of the usual 2.5 minutes.

Figure 9:
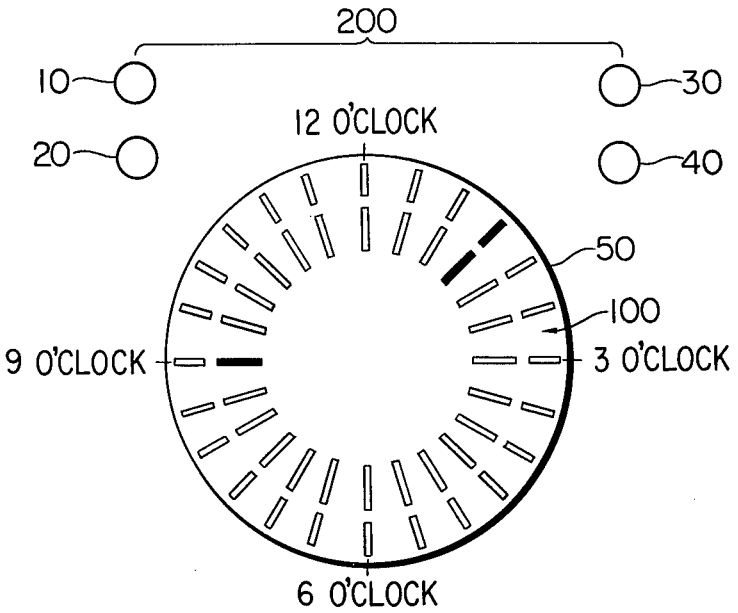
Figure 10:
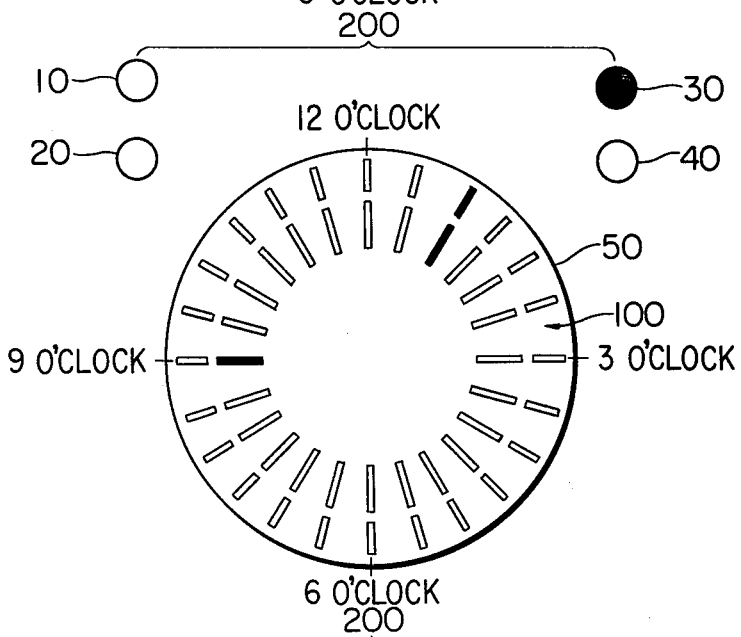

This is illustrated in FIGS. 9 and 10. Suppose that the actual time is 9:08. During normal display, the main display portion 100 only is driven, and since it indicates time in units of 2.5 minutes, it indicates 7 and a half minutes after 9 o'clock, as seen in FIG. 9. However, if the auxiliary display portion 200 is also driven, as shown in FIG. 10, the main display portion 100 is automatically made to indicate the time in units of 5 minutes. The elements of the main display portion 100 representing the minute hand move backwards to the nearest 5-minute position and display 9:05. By noting that the fifth display element 30 is lit, one can clearly read from this display that the time is 9:08.

Figure 11:
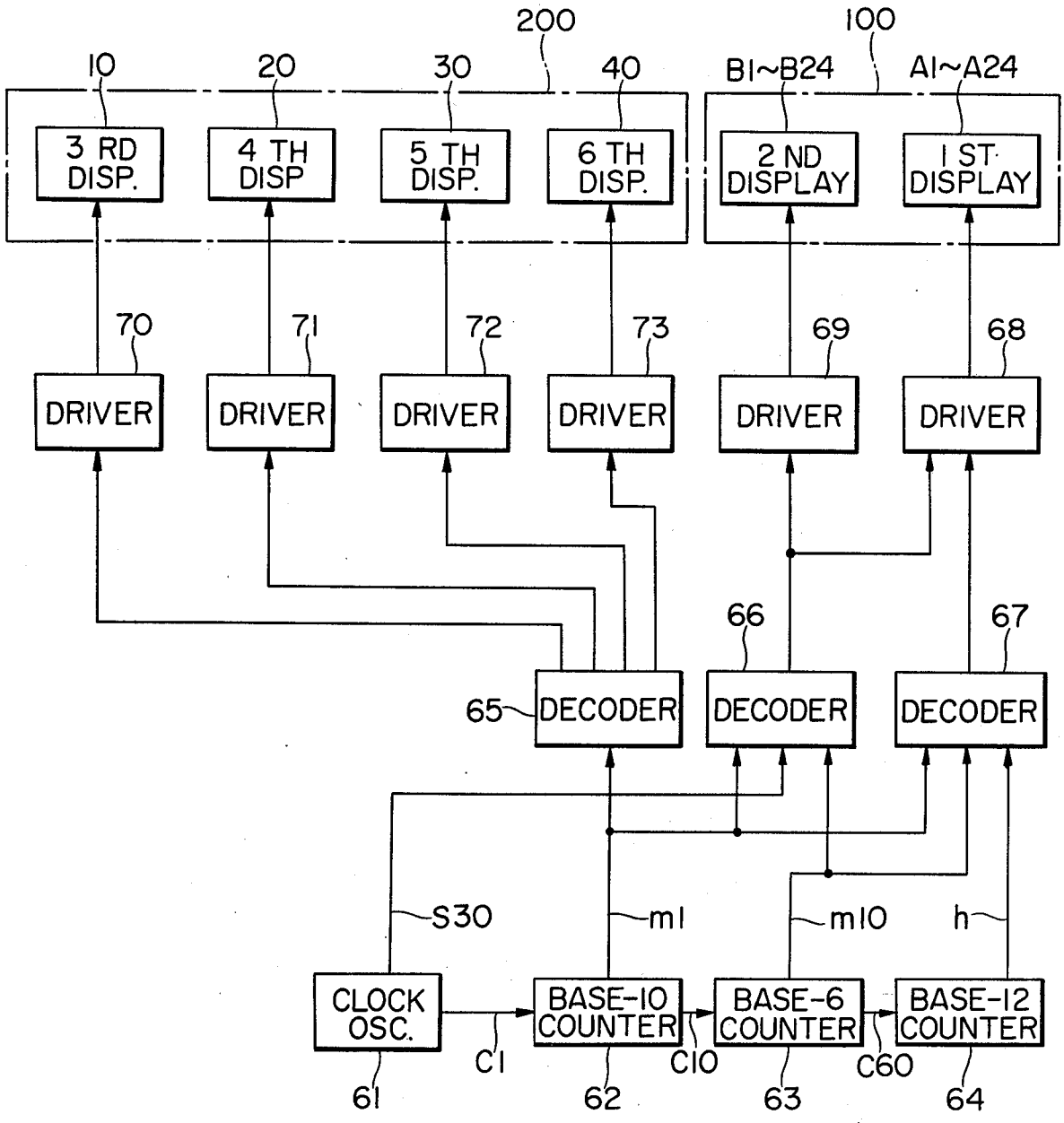
FIG. 11 is a block diagram of one example of a driving circuit for the present invention.

FIG. 11 is a block diagram representing one embodiment of a driving circuit for the time display apparatus of the present invention for carrying out the third of the three display modes described above. First, a clock oscillator 61 is provided for producing clock pulse C1 once per minute and for producing 30-second signal s30 which turns on or off every 30 seconds.

The clock pulse C1 emitted at one minute intervals from clock oscillator 61 is supplied to base-10 counting circuit 62 as a trigger pulse. The outputs of base-10 counting circuit 62, which indicate the status at any time of this counting circuit, are collectively referred to as 1-minute signal ml. Every 10 minutes, base-10 counting circuit 62 produces a carry signal C10 which is supplied to a base-6 counting circuit 63 as a trigger pulse. Every 60 minutes, a carry signal C60 is produced by the base-6 counting circuit 63. Accordingly, these two counting circuits 62 and 63 together form a base-60 counting circuit. The outputs of base-6 counting circuit 63, which indicate the status at any time of this counting circuit, are collectively referred to as 10-minute signal m10. The carry signal C60 is supplied to a base-12 counting circuit 64 as a trigger pulse. This causes the base-12 counting circuit 64 to advance every 60 minutes. Every 720 minutes=12 hours, base-12 counting circuit 64 is caused to make one cycle. The outputs of base-12 counting circuit 64, which indicate the status at any time of this counting circuit, are collectively referred to as hour signal h.

The 1-minute signal ml of the counting circuit 62 is supplied to decoders 65, 66, and 67, and the hour signal h from the counting circuit 64 is supplied to decoder 67. Decoder 65 carries out decoding of the 1-minute signal ml from counting circuit 62, and when the number of minutes past the hour is a number ending in 1 or 6 minutes. decoder 65 outputs an ON signal to drive driver 70. At 2 and 7 minutes, it outputs an ON signal to drive driver 71, at 3 and 8 minutes an ON signal to drive driver 72, and at 4 and 9 minutes an ON signal to drive driver 73.

Decoder 66 combines the 1-minute signal ml from counting circuit 62, the 10-minute signal m10 from counting circuit 63, and the 30-second signal s30 from clock oscillator 61 and forms a decoder signal which drives drivers 68 and 69 in parallel. Driver 68 operates the first display element group and driver 69 operates the second display element group. Every 2.5 minutes during normal display and every 5 minutes at other times, the elements which indicate the number of minutes are lit and extinguished in response to this decoder signal.

Decoder 67 combines the 1-minute signal ml from counting circuit 62, the 10-minute signal m10 from counting circuit 63, and the hour signal h from counting circuit 64 and forms a decoder signal which drives driver 68 every 30 minutes to light and extinguish the appropriate elements of the first display element group which indicate the hour.

Driver 70 drives the third display element 10 of the auxiliary display portion 200 to indicate when the number of minutes past the hour is a number ending in 1 or 6. Driver 71 drives fourth display element 20 to indicate when the number of minutes ends in 2 or 7. Driver 72 drives fifth display element 30 to indicate when the number of minutes ends in 3 or 8, and driver 73 drives sixth display element 40 to indicate when the number of minutes ends in 4 or 9.

In short, in the above circuit, drivers 68 and 69 are controlled in parallel by the minute timing signal of decoder 66, and first and second display element groups are thereby driven to indicate the number of minutes. Driver 68 is controlled by the hour timing signal of decoder 67, and first display element group A1–A24 is thereby driven to indicate the hour. The above-described minute display is in units of 2.5 minutes, but when a display in units of one minute is necessary, such as when adjusting the display, one of third through sixth display elements 10, 20, 30, and 40 is driven every one minute in response to the minute timing signal from decoder 65, and the number of minutes can be displayed in units of one minute.

However, third through sixth display elements 10, 20, 30, and 40 each serve to indicate two of the numbers from 1 to 9 (for example, third display element 10 corresponds to 1 and 6). Distinguishing between these two possibilites is accomplished by referring to the location of the minute display of the main display portion 100. This is illustrated in FIG. 10, in which the first display element group indicates 9 o'clock, the first and second display element groups together indicate that it is at least 5 minutes but less than 10 minutes after the hour, and the fact that the fifth display element 30 is ON indicates that the precise number of minutes after the hour is 8. In short, this time display indicates 9:08.

Figure 12:
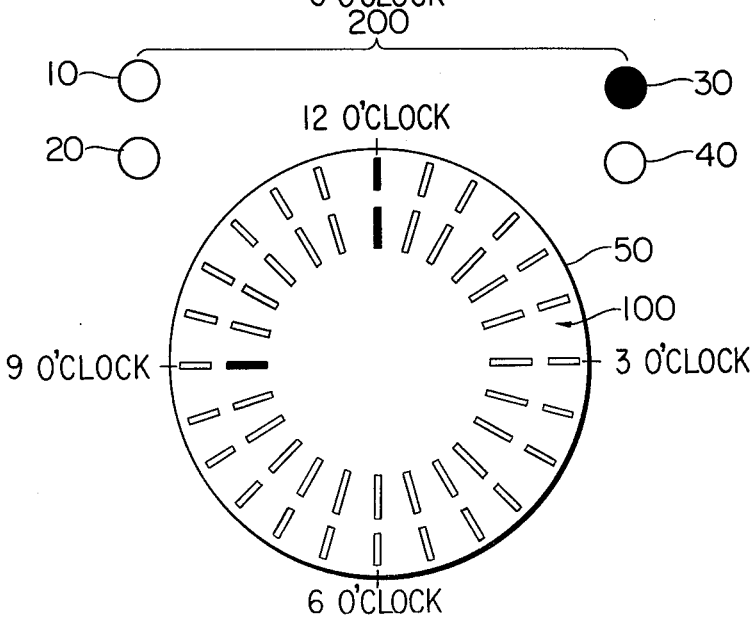

In FIG. 12, the display is shown at a different time. Here, the first display element group indicates 9 o'clock, the first and second display element groups further indicate that it is less than 5 minutes after the hour, and the fact that the fifth display element 30 is ON indicates that the precise time is 3 minutes after the hour. Thus, the displayed time is 9:03.

In this manner, although the fifth display element 30 can indicate either 3 or 8 minutes, by observing whether the minute display of the first and second display groups indicates 0–4 minutes or 5–9 minutes, one can easily determine which of these two possibilities is correct.

The following alternative method can be used for advancing the minute hand of the main display portion 100 at 5-minute intervals when adjusting the display. As an example, a display of 9:00 will be used as a starting point. If a switch (not shown in the figures) is operated to advance the display 1 minute, the first and second display element groups remain unchanged while the third display element 10 turns ON to indicate 9:01. If this switch is again operated to further advance the time 1 minute, the first and second display element groups remain unchanged, the third display element 10 turns OFF, and the fourth display element 20 turns ON to indicate 9:02. When the switch is again operated to advance 1 minute, the first and second display element groups remain unchanged, the fourth display element 20 turns OFF, and the fifth display element 30 turns ON to indicate 9:03. To advance to 9:04, the switch is again operated with the result that the fifth display element 30 turns OFF and the sixth display element 40 turns ON, with no change in the first and second display element groups. Now, when the switch is operated to further advance 1 minute, the sixth display element 40 goes OFF so that the third through sixth display elements are all OFF, and the minute hand of the first and second display element groups moves to the 5-minute location to indicate 9:05. In this manner, the third display element 10 to the sixth display element 40 are successively turned ON, after which the sixth display element 40 turns OFF (indicating a change from 4 to 5 minutes or from 9 to 10 minutes), and the display of minutes produced by the first and second display element groups progresses from the position indicating 0 minutes to that indicating 5 minutes (or alternatively from a position indicating 5 minutes to one indicating 10 minutes). This manner of advancing the minute hand more readily makes a visual impression than the method in which the minute hand is advanced every 2.5 minutes, and is thus thought to be more easily comprehensible.

Although the above-described circuit of FIG. 11 is for driving the display according to the third mode of display, it will be clear to those skilled in the art that this circuit can be easily adapted for use for either of the other modes of display simply by altering decoders 65 and 66.

The shape in which the first and second display element groups are arranged is not limited to the ring shape of the above embodiments, but may be oval, polygonal, or of any other desired shape. Further, the shape of the elements of the first and second display element groups need not necessarily be long and reectangular like the ones shown in the figures. Further, the third, fourth, fifth, and sixth display elements need not be round but can be replaced by numbers, alphabetic characters, or any other appropriate indicators. In addition, the manner of arranging the auxiliary display portion need not be the same as the one used in the above embodiments. Any desired configuration may be used. For example, the third through sixth display elements may be located in the center of the display board 50, with the same effect being clearly obtainable.

What is claimed is:

1. In a time display apparatus for indicating the time of day in hours and minutes having a first main display means for displaying the hour and the number of minutes in units of 2.5 minutes, first driving means for driving said first display means, auxiliary display means for displaying the number of minutes past the hour in units of 1 minutes, and second driving means for driving said auxiliary display means, wherein said main display means consists of a first display element group having twenty-four display elements substantially evenly spaced about a common center and extending in the radial direction from said center and a second display element group composed of twenty-four display elements disposed about the outer circumference of said first display element group, each element of said second display group being aligned in the radial direction with a corresponding element of said first display group.

2. A time display apparatus as defined in claim 1, wherein said first and second display element groups each consist of 24 display elements.

3. A time display apparatus as defined in claim 1, wherein said first driving means drives a single display element of said first display element group, thereby indicating the hour, and drives a single element of said first display element group together with the element of said second display element group lying on the same radial line, thereby indicating the number of minutes in units of 2.5 minutes.

4. A time display apparatus as defined in claim 3, wherein said second driving means drives said third display element when the number of minutes past the hour is a number ending in 1 or 6, and drives said fourth display element when the number of minutes past the hour is a number ending in 2 or 7, and drives said fifth display element when the number of minutes past the hour is a number ending in 3 or 8, and drives said sixth display element when the number of minutes past the hour is a number ending in 4 or 9.

5. A time display apparatus as defined in claim 4, wherein said second driving means drives said third display element when the number of minutes past the hour is a number ending in 1, 2, 3, 4, 6, 7, 8, or 9, and drives said fourth display element when the number of minutes past the hour is a number ending in 2, 3, 4, 7, 8, or 9, and drives said fifth display element when the number of minutes past the hour is a number ending in 3, 4, 8, or 9, and drives said sixth display element when the number of minutes past the hour is a number ending in 4 or 9.

6. A time display apparatus as defined in claim 1, further comprising means for operating said second drive means only when it is desired to know the number of minutes past the hour in units of 1 minute, such as when adjusting the display.

7. A time display apparatus as defined in claim 5, further comprising means for operating said second drive means only when it is desired to know the number of minutes past the hour in units of 1 minute, such as when adjusting the display.

8. A time display apparatus ad defined in claim 3, wherein said first driving means drives said main display means so as to advance every 2.5 minutes during normal display and every 5 minutes when said auxiliary display means are being driven simultaneously.

* * * * *